US005635319A

United States Patent [19]

Hotta et al.

[11] Patent Number: 5,635,319

[45] Date of Patent: *Jun. 3, 1997

[54] IMAGE FORMATION METHOD USING REVERSIBLE THERMOSENSITIVE RECORDING MATERIAL

[75] Inventors: Yoshihiko Hotta, Mishima; Kunichika Morohoshi, Numazu; Fumihito Masubuchi, Mishima, all of Japan

[73] Assignee: Ricoh Company, Ltd., Tokyo, Japan

[ * ] Notice: The term of this patent shall not extend beyond the expiration date of Pat. No. 5,489,494.

[21] Appl. No.: 505,751

[22] Filed: Jul. 21, 1995

Related U.S. Application Data

[63] Continuation of Ser. No. 118,316, Sep. 9, 1993, Pat. No. 5,489,494.

[30] Foreign Application Priority Data

Sep. 11, 1992 [JP] Japan ..... 4-269798

[51] Int. Cl.$^6$ ..... B41M 5/00

[52] U.S. Cl. ..... 430/19; 503/201; 430/21; 430/964; 347/179; 347/195

[58] Field of Search ..... 430/19, 21, 964; 503/201; 347/179, 195; 346/21

[56] References Cited

U.S. PATENT DOCUMENTS

| | | | |
|---|---|---|---|
| 5,274,460 | 12/1993 | Yamada et al. | 358/296 |
| 5,278,128 | 1/1994 | Hotta et al. . | |
| 5,298,476 | 3/1994 | Hotta et al. . | |
| 5,371,522 | 12/1994 | Miyawaki et al. . | |
| 5,379,058 | 1/1995 | Obu et al. . | |
| 5,426,086 | 6/1995 | Hotta et al. . | |
| 5,448,065 | 9/1995 | Masubuchi et al. . | |
| 5,489,494 | 2/1996 | Hotta et al. | 430/19 |

*Primary Examiner*—John A. McPherson

*Attorney, Agent, or Firm*—Oblon, Spivak, McClelland, Maier & Neustadt, P.C.

[57] ABSTRACT

There is disclosed a method of successively forming and/or erasing images selectively in different portions of a recording layer of a recording medium which comprises a reversible thermosensitive recording material capable of recording images and erasing the same by reversibly changing the transparency or the color tone of the portions of the recording layer with the application of heat thereto, depending upon the temperature thereof, in such a manner that the same portion of the recording layer is not continuously used for image formation and/or erasure in excess of a predetermined number of times, thereby repeating the use of the recording medium for an extended period of time.

2 Claims, 3 Drawing Sheets

IMAGE FORMATION METHOD USING REVERSIBLE THERMOSENSITIVE RECORDING MATERIAL

This is a Continuation of application Ser. No. 08/118,316 filed on Sep. 9, 1993, now U.S. Pat. No. 5,489,494.

BACKGROUND OF THE INVENTION

1. Field of the Invention

The present invention relates to a method of successively forming and/or erasing images selectively in different portions of a recording layer of a recording medium which comprises a reversible thermosensitive recording material capable of repeatedly recording images there and erasing the same therefrom.

2. Discussion of Background

Recently attention has been paid to a reversible thermosensitive recording material capable of termporarily recording images thereon and erasing the same therefrom when such images become unnecessary, and repeatedly performing such image recording and erasing operations.

For example, as disclosed in Japanese Laid-Open Patent Application 55-154198, there is conventionally known a reversible thermosensitive recording material in which an organic low-molecular-weight material such as a higher fatty acid is dispersed in a matrix resin such as a vinyl chloride based resin.

However, when images are formed in the conventional reversible thermosensitive recording material and erased therefrom many times by the application of heat thereto, especially using a thermal head, the surface of the reversible thermosensitive recording material takes scratches because both heat and pressure are applied to the recording material at the same time. As the scratches are increased on the surface of the recording material, it becomes difficult to carry out the image formation uniformly.

To reduce the scratches on the recording material when the thermal head is employed for image formation and erasure, the inventors of the present invention have proposed to provide a protective layer on the surface of the recording material, as disclosed in Japanese Laid-Open Patent Applications 63-221087, 63-318385 and 2-566. However, in the case where the image forming and erasing operation is repeated many times in the recording material, the surface of the recording material cannot be sufficiently protected from the scratches merely by forming the protective layer on the conventional reversible thermosensitive recording material.

In addition, when both heat and pressure are simultaneously applied to the recording material every time the image formation and erasure are performed, for instance, by using the thermal head, domains of the organic low-molecular-weight material, which is dispersed in the matrix resin at the initial stage, are apt to coalesce. As a result, the whiteness degree of a milky opaque portion in the recording material is decreased, and the image contrast is lowered.

SUMMARY OF THE INVENTION

Accordingly, an object of the present invention is to provide a method of successively forming and/or erasing images in a recording material comprising a reversible thermosensitive recording material, capable of drastically increasing the life of the recording material.

The above-mentioned object of the present invention can be achieved by a method of successively forming and/or erasing images selectively in different portions of a recording layer of a recording medium which comprises a reversible thermosensitive recording material capable of recording images and erasing the same by reversibly changing the transparency or the color tone of the portions of the recording layer with the application of heat thereto, depending upon the temperature thereof, in such a manner that the same portion of the recording layer is not continuously used for image formation and/or erasure in excess of a predetermined number of times, thereby repeating the use of the recording medium for an extended period of time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 2(*b*) and 2(*c*) are schematic views showing that the recording position of a symbol of number "1" in the first image formation is sifted a plurality of times in the successive formation of images according to the image formation method of the present invention;

DESCRIPTION OF THE PREFERRED EMBODIMENTS

The present invention will now be explained in detail by referring to the figures.

Figure 1:
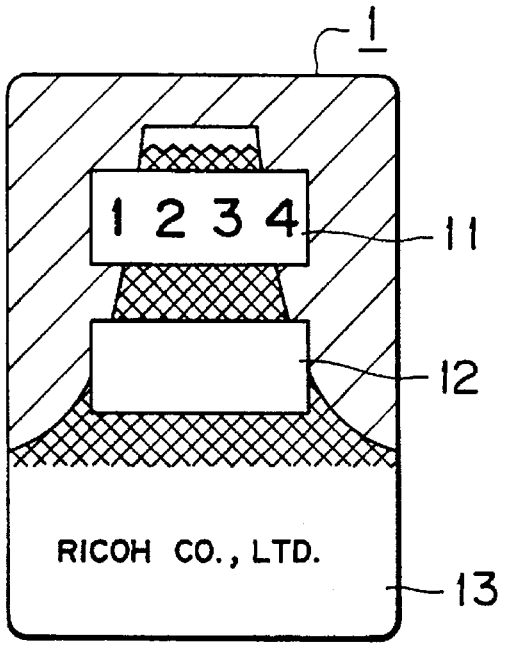
FIG. 1 is a schematic plan view of a card-type recording medium for use with the image formation method of the present invention, which has two portions used for image formation and/or erasure.

FIG. 1 schematically shows one embodiment of a recording medium for use with the image formation method of the present invention, which has two different portions used for image formation and/or erasure. In this case, these two different portions are set at predetermined positions in a recording layer of the recording medium. As shown in FIG. 1, there are two different portions 11 and 12 used for image formation and/or erasure in a recording medium 1. As a matter of course, the number of portions can be freely increased in the recording medium 1. Reference numeral 13 indicate a non-image recording portion.

When a plurality of portions are set at predetermined positions in the recording layer of the recording medium, the following two image recording method are usable:

(1) image recording is selectively performed in different portions, with shifting the portion in turn at intervals of a predetermined number of times in the course of the successive formation and/or erasure of images; and (2) image recording is selectively performed in different portions, with the portion used for image formation and/or erasure successively being shifted to a new portion without returning to the previously used ones.

For instance, in FIG. 1, images are alternately recorded in the portions 11 and 12 by the aforementioned image recording method (1). More specifically, by using a single thermal head, as images are recorded in the portion 11, the images recorded in the portion 12 are erased in one-time operation. Subsequently, as the images recorded in the portion 11 are erased, images are newly recorded in the portion 12. According to the recording method (1), the card-type recording medium 1 provided with a plurality of image recording portions comprising a recording material may be passed through the thermal head in one direction in order to achieve the above-mentioned one-time operation of image recording and erasing. Accordingly, the structure of an image recording apparatus can be made simple. In this case, the energies necessary for image formation and image erasure can be changed by controlling the voltage and pulse width applied to the thermal head.

In FIG. 1, the same portion 11 or 12 in the recording medium 1 is not continuously used for image formation and/or erasure in excess of a predetermined number of times. The predetermined number of times for the use of the same portion 11 or 12 is at least 1. After the image formation and/or erasure is carried out a plurality of times in the same portion 11 or 12, the portion used for image formation and/or erasure may be shifted from 11 to 12, or 12 to 11. The number of image recording operations repeated in the same portion may be fixed or changed every image recording operation in accordance with the purpose of the recording medium 1.

In addition, when images are recorded in one portion of a recording layer of the recording medium, the images previously recorded in the other portion may not be erased. For example, in a recording medium provided with five portions used for image formation and/or erasure, it is supposed that all of the five portions have been used for image formation. Thereafter, when the sixth image forming operation is carried out, only the images recorded in a first portion may be erased. Thus, the image information can appropriately be maintained for a while.

According to the image recording method (1), as a matter of course, the life of the recording medium 1 can be increased two times by the provision of two portions 11 and 12 therein. When three or more portions used for image formation and/or erasure are provided in the recording medium 1, the life of the recording medium 1 can be increased three times or more.

The previously mentioned image recording method (2) will now be explained with reference to FIG. 1. For instance, the image forming and erasing operation is repeated in the portion 11 a fixed number of times, and after the completion of the image recording in the portion 11, the portion to be used for image formation and/or erasure is shifted to the portion 12 and the image forming and erasing operation is similarly repeated in the image recording area 12 a fixed number of times.

According to the image recording method (2), the life of the recording medium 1 can also be increased two times by the provision of two portions 11 and 12 therein. When three or more portions used for image formation and/or erasure are provided in the recording medium 1, the life of the recording medium 1 can be increased three times or more.

The image recording method (2) has the advantage that the life of the recording medium 1 can easily be recognized by the user of the recording medium 1 because the currently used portion in the recording medium 1 is quite obvious.

The predetermined number of times of image forming and erasing operations repeated in the same portion of the recording layer in the above-mentioned image recording methods (1) and (2) is determined by the life of a recording material for use in each portion of the recording layer. The number of times of repeated image forming and erasing operations can be fixed by previously detecting the maximum number of times for the use of the recording medium and storing the number thus detected in an information memory portion in the recording medium so as to shift the portion to be used for image formation and/or erasure. Alternatively, a predetermined portion of the recording layer may be shifted by detecting the degree of deterioration of the recording material for use in the predetermined portion.

Figure 2A:
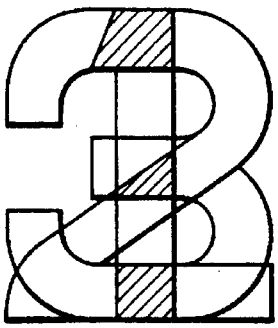
FIG. 2(*a*) is a schematic view showing that symbols of numbers "1", "2" and "3" formed at the same recording position overlap each other.
Figure 2B:
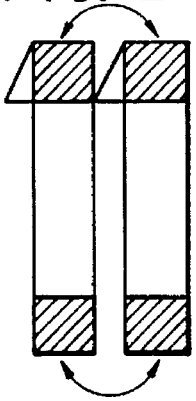
Figure 2C:
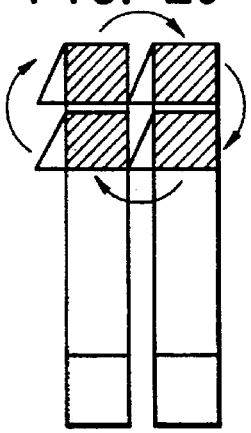

Referring to FIGS. 2(*a*) to 2(*c*), another embodiment of the image formation method of the present invention will now be explained.

In this case, image formation and/or erasure is also selectively in different portions of a recording layer of a recording medium which comprises a reversible thermosensitive recording material. The unit of each of the above-mentioned portions of the recording layer of the recording medium is a picture element, and different portions of the recording layer of the recording medium are selectively set by shifting a predetermined portion of the recording layer in the course of the successive formation and/or erasure of images. This embodiment of the image formation method according to the present invention can prevent the same portion comprising at least one picture element from being concentratedly used for the image formation, thereby reducing the deterioration of the recording material.

In FIGS. 2(*a*) to 2(*c*), each symbol of a number is composed of picture elements corresponding to the portions of a recording layer of a recording medium. For example, when the thermal energy is applied to the recording medium by using a thermal head, a heating element of the thermal head is regarded as a picture element of the image. Or when the image is intendedly composed of a plurality of segments, each segment being composed of the heating elements of the thermal head, the segment is regarded as a picture element.

As shown in FIG. 2(*a*), symbols of numbers "1", "2" and "3" are recorded at the same position in the recording material, so that these three numbers overlap each other. The overlapped portions common to three numbers are indicated by shaded portions. As is apparent from FIG. 2(*a*), some portions in the recording material are concentratedly used for image formation even when different symbols of umbers are formed. By the deterioration of the recording material only at those portions, the entire recording material is recognized as deteriorating. Such a phenomenon also occurs in the course of the recording of a set of kanji, hiragana, katakana and alphabet.

In FIG. 2(*b*), a symbol of number "1" is first recorded at a certain position in the recording medium. According to the image formation method of the present invention, when a symbol of number "1" is again recorded in the recording material, the recording position is shifted to the right or left of the previous recording position so as not to overlap the shaded portions of the two symbols of number "1" each other. Thus, the life of the recording medium can be increased two times.

Furthermore, as shown in FIG. 2(*c*), when a symbol of number "1" is repeatedly recorded in the recording medium, the recording position of the symbol is shifted four times in rotation as indicated by the arrows so that the shaded portions of the symbols of number "1" do not overlap each other, with the result that the life of the recording medium can be increased four times.

According to such an image formation method of shifting a predetermined portion corresponding to one picture element or a segment of picture elements in the successive image formation and/or erasure, it is not necessary to provide an excessively large image recording area in the recording medium, as compared with the previously mentioned image formation method with reference to FIG. 1, so that the non-image recording portion 13 as shown in FIG. 1 can effectively be utilized, for example, for advertisement by printing.

In this type of image formation method, it is desirable that the number of times the recording medium has been used for image formation and/or erasure be stored in an information memory portion of the recording medium. In addition, the information memory portion in the recording medium may further store a maximum number of times for the use of the recording medium. The different portions may be selectively set in the recording medium by shifting a predetermined portion of the recording layer in the course of the successive formation and/or erasure of images in reference to the number of times the recording medium has been used for image formation and/or erasure.

Alternatively, the different portions are selectively set in the recording medium by shifting a predetermined portion of the recording layer in the course of the successive formation and/or erasure of images in accordance with the degree of deterioration of the reversible thermosensitive recording material during the repeated use thereof.

The above-mentioned portions used for image formation and/or erasure can be provided on one side of the recording medium, or both sides thereof.

In the case where the information memory portion is necessary for storing the number of times of repeated image forming operations therein, the IC or optical memory may be mounted on the non-image recording portion of the recording medium: Alternatively, a magnetic recording portion may be provided in the non-image recording portion, or under the above-mentioned portions use for image formation and/or erasure. For use in practice, the number of times the recording medium has been used for image formation and/or erasure stored in the information memory portion is detected by the image recording apparatus, and the image forming and/or erasing operation is carried out at a predetermined portion in accordance with the current number of times. By the image recording apparatus, the current number of times of image forming operation is detected, and the number of image forming operations is increased by one during the current image forming operation or after completion of the current image forming operation.

In the case where the number of image forming operations repeated in the same portion is determined by detecting the degree of deterioration of the recording material for use in the portion, the deterioration of the recording material, which varies depending upon the kind of recording material to be employed, is generally represented by the decrease in the image density and the increase in the background density. To detect the deterioration of the recording material, the change in image density may be measured.

For example, when the previously mentioned reversible thermosensitive recording material in which an organic low-molecular-weight material is dispersed in a matrix resin is repeatedly used for image formation and erasing operations, the deterioration thereof is represented by the decrease in whiteness degree of a milky opaque portion of the recording material for use in practice.

Figure 3:
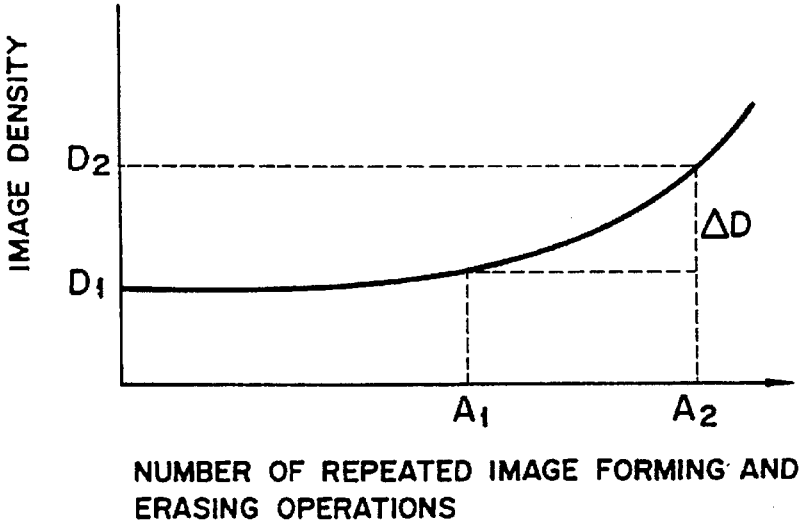
FIG. 3 is a graph showing the relationship between the white opaque density of a milky opaque portion in a reversible thermosensitive recording material and the number of repeated image forming and erasing operations.

FIG. 3 is a graph which shows the relationship between the number of repeated image forming and/or erasing operations and the image density of an image in a milky white opaque color formed in the above-mentioned reversible thermosensitive recording material. There is obtained a curve which shows the deterioration of the reversible thermosensitive recording material. As can be seen from the graph in FIG. 3, image density $D_1$ of a milky white opaque image recorded at a predetermined portion in the recording material can be maintained until the number of repeated image forming operations reaches $A_1$. When the number of repeated image forming operations exceeds $A_1$, the whiteness degree of a milky opaque image at the predetermined portion gradually decreases, namely, the image density of the milky opaque image increases, and the image density attains to a critical image density $D_2$. The number $A_2$ corresponding to the critical image density $D_2$ may previously be stored as the maximum number of times. Thus, different portions can be selectively set in the recording medium by shifting the predetermined portion of the recording layer in the course of the successive image formation and/or erasure when the image density of a milky opaque image at the predetermined portion attains to $D_2$, that is, the image forming operation is repeated $A_2$ times in the predetermined portion. The number of repeated image forming operations corresponding to the critical image density $D_2$ changes depending on the operating circumstances, and recording conditions such as the applied energy and pressure.

The image density of an image formed in the recording material can be measured by using light-application means and light-detecting means. When a support of the reversible thermosensitive recording material to be employed is transparent, the light-application means and the light-detecting means are provided facing each other with the recording medium between, thereby detecting the changes in light transmittance. In contrast to this, when the support of the reversible thermosensitive recording material is not transparent, both the light-application means and the light-detecting means are provided on the side of recording portions of the recording medium to detect the changes in light reflectance. In the case where the support is transparent, the changes in light reflectance can be detected by disposing a light-reflecting plate or a light-absorbing plate behind the recording medium, opposite to the light-application means and the light-detecting means with respect to the recording medium.

It is preferable that the image density be measured at a position where the image forming operation is repeated at regular intervals. For example, the preferable position for measuring the image density in the recording medium is where an image is recorded every time the recording medium is caused to pass through the thermal head, or where an image is regularly recorded, for example, once per two- to four-time operations of causing the recording medium to pass through the thermal head. Even through the image density of an image is measured at a position where images are irregularly recorded, the degree of deterioration of the entire recording material cannot be detected accurately. When there is no proper position in the recording medium for measuring the image density, an image may be regularly recorded in a fixed portion for the purpose of detecting the degree of deterioration of the reversible thermosensitive recording material, and the image density in this portion may be measured.

The reversible thermosensitive recording material for use with the image formation method of the present invention is a material capable of reversibly causing a visual change depending on the temperature of the material. Particularly, in the present invention, the recording material which can reversibly indicate a change in color, not a change in shape is employed. Such a color change of the recording material takes place by the changes of light transmittance, light reflectance, absorption wavelength, and the scattering properties of the recording material. By utilizing the above-mentioned changes of the characteristic properties in combination, the reversible thermosensitive recording material for use in the present invention causes the reversible color change, thereby forming an image therein and erasing the same therefrom.

Any recording materials capable of reversibly changing the transparency or color tone depending upon the temperature thereof are available. For example, a reversible thermosensitive recording material comprising two or more kinds of polymers is disclosed in Japanese Laid-Open Patent Application 61-258853, which recording material has the property that the state can be reversibly changed from a transparent state to a white opaque state, and vice versa, because of the difference in compatibility of the polymers. In addition, a reversible thermosensitive recording material comprising a liquid crystal polymer is disclosed in Japanese Laid-Open Patent Application 62-66990, which utilizes the phase change of the liquid crystal polymer.

Furthermore, there are proposed several recording materials, each of which assumes a first color development state at a first predetermined temperature higher than room temperature, and further assumes a second color development state by heating the recording material at a second predetermined temperature higher than the first temperature, and then cooling. This kind of recording material is preferred in the present invention. For example, a recording material which can assume a transparent state at a first predetermined temperature and a white opaque state at a second predetermined temperature is proposed, as disclosed in Japanese Laid-Open Patent Application 55-154198; a recording material which can produce a color at a second predetermined temperature and erase the produced color at a first predetermined temperature, as disclosed in Japanese Patent Application 2-414438; a recording material which can assume a white opaque state at a first predetermined temperature and a transparent state at a second predetermined temperature, as disclosed in Japanese Laid-Open Patent Application 3-169590; and recording materials which can assume a black, red or blue color at a first predetermined temperature, and erase the produced color at a predetermined second temperature, as disclosed in Japanese Laid-Open Patent Applications 2-188293 and 2-188294.

As previously mentioned, the reversible thermosensitive recording materials preferred in the present invention can be divided into the following two groups:

(1) a recording material which can reversibly assume a transparent state and a white opaque state; and (2) a recording material which can cause a reversible color change by the chemical change of a coloring material such as a dye contained therein.

As a representative example of the recording material (1), there is proposed a recording material comprising a support and a thermosensitive recording layer formed on the support, which comprises a matrix resin such as polyester, and an organic low-molecular-weight material such as a higher alcohol or a higher fatty acid, dispersed in the matrix resin, as previously mentioned. On the other hand, a leuco-based thermosensitive recording material with improved reversibility is proposed as the representative example of the recording material (2).

The reversible thermosensitive recording material (1) will now be described in detail.

Each of the image recording portions capable of reversibly switching the transparency comprises the recording material (1) comprising as the main components the matrix resin and the organic low-molecular-weight material dispersed in the matrix resin. The recording material (1) can assume a transparent state within a temperature region characteristic to the recording material.

The reversible thermosensitive recording material (1) utilizes its property that the transparency can be changed reversibly from a transparent state to an opaque state, and vice versa, depending on the temperature thereof. It is supposed that the difference between the transparent state and the milky white opaque state of the recording material (1) results from the following phenomena. In the transparent state, the matrix resin and the organic low-molecular-weight material dispersed therein adhere to each other without any gap therebetween, and there is no air space in the organic low-molecular-weight material. Therefore, the light which enters the thermosensitive layer from one side passes therethrough to the opposite side, without being scattered, thus the reversible thermosensitive recording material (1) appears transparent. In contrast to this, when the thermosensitive recording material (1) is in the milky white opaque state, the organic low-molecular-weight material is composed of polycrystals consisting of numerous small crystals, with air space generated at the boundaries of crystals or the interface between the crystals of the low-molecular-weight material and the matrix resin, so that the light which enters the recording layer is refracted and reflected a number of times on the interface between the air space and the crystals of the low-molecular-weight material and between the air space and the matrix resin, whereby the light is scattered. As a result, the thermosensitive recording layer of the recording material (1) becomes opaque in a milky white color.

The transition of the state of the reversible thermosensitive recording layer of the recording material (1) depending on the temperature thereof will now be explained by referring to FIG. 4.

Figure 4:
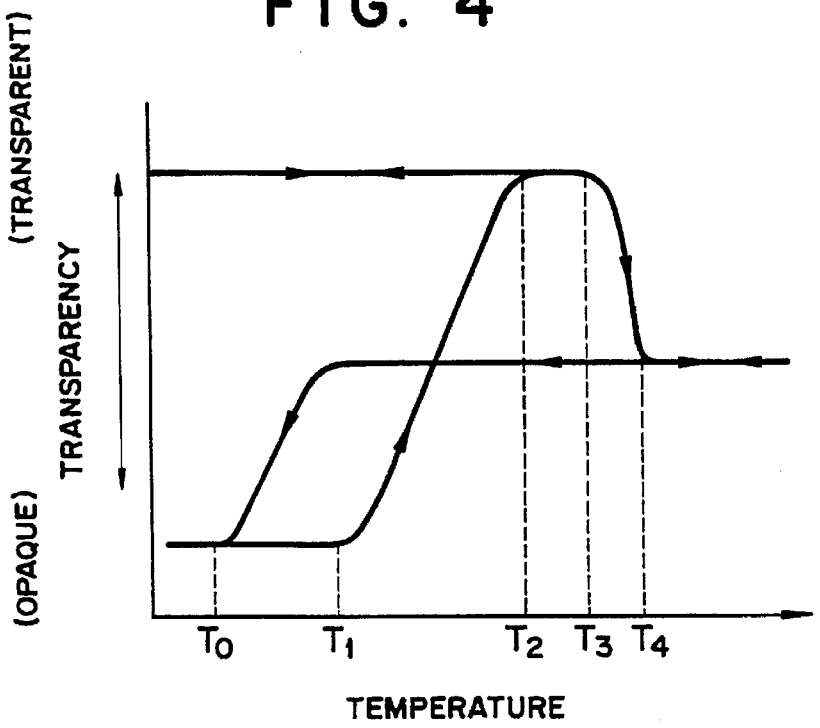
FIG. 4 is a graph in explanation of the principle of the formation and erasion of images in a reversible thermosensitive recording material for use in the present invention.

In FIG. 4, it is supposed that the reversible thermosensitive recording layer comprising a matrix resin and an organic low-molecular-weight material dispersed in the matrix resin is initially in a milky white opaque state at room temperature $T_0$ or below. When the thermosensitive recording material is heated to temperature $T_1$ or above, the thermosensitive recording layer gradually becomes transparent. Thus, the recording material reaches a maximum transparent state at temperature $T_2$ to $T_3$. Even if the recording material which is already in the maximum transparent state is cooled to room temperature $T_0$ or below, the maximum transparent state is maintained.

It is considered that this is because the matrix resin in the recording layer begins to soften at temperature $T_1$, and the resin is contracted during the progress of softening, and then, the air space between the resin and the particles of the organic lo-molecular-weight material or within the particles of the organic low-molecular-weight material is decreased, with the result that the transparency of the recording layer is gradually increased during the heating operation from $T_1$ to $T_3$. The organic low-molecular-weight material is in a semi-melted state within a temperature from $T_2$ to $T_3$. The remaining air space in the recording layer is filled up with the melted organic low-molecular-weight material, so that the recording layer assumes the maximum transparent state. When the recording layer which is already in the maximum transparent state is cooled to room temperature $T_0$ or below, the organic low-molecular-weight material in the recording layer is cooled with the seed crystal remaining therein. During the cooling operation to $T_0$ or below, therefore, the organic low-molecular-weight material crystallizes at a relatively high temperature. At this time, the matrix resin is in the softened state, so that is serves to compensate for the volume change of the particles of the organic low-molecular-weight material caused by the crystallization thereof. As a result, no air space is formed in the thermosensitive layer, thereby maintaining the transparent state.

When the recording layer in the maximum transparent state is further heated to temperature $T_4$ or more, it reaches a medium state which is between the maximum transparent state and the maximum milky white opaque state. When the recording material in the medium state at temperature $T_4$ or more is cooled to room temperature $T_0$ or below, the recording material returns to the original maximum opaque state, without passing through any transparent state. It is considered that this is because the organic low-molecular-weight material is completely melted when heated to temperature $T_4$ or above, and then crystallizes by supercooling at a temperature slightly higher than room temperature $T_0$. At this time, the matrix resin cannot compensate for the volume change of the organic low-molecular-weight material caused by the crystallization, with the result that the air space is formed in the thermosensitive recording layer. Therefore, the recording layer returns to the white opaque state.

The graph shown in FIG. 4, in explanation of the relationship between the transparency of the reversible thermosensitive recording material (1) and the temperature thereof, is of just one representative example of the recording materials (1). The degree of transparency at each step varies depending on the kinds of components consitituting the reversible thermosensitive recording material (1).

With the above-mentioned principle of the reversible change in transparency being taken into consideration, a milky white opaque image can be obtained on a transparent background, or a transparent image can also be obtained on a milky white opaque background by selectively applying the thermal energy to the reversible thermosensitive recording material (1) in the present invention. Further, such image formation and erasure can be repeated over a long period of time.

When a colored sheet is placed behind the reversible thermosensitive recording layer of the recording material (1), a colored image can be obtained on a white opaque background or a white opaque image can be obtained on a colored background.

In the case where the images formed in the reversible thermosensitive recording material (1) are projected on a screen using an over head projector (OHP), a milky white opaque portion in the recording material (1) appears dark and a transparent portion in the recording material (1), through which the light passes becomes a bright portion on the screen. In addition, to see the images formed in the recording material (1) as reflected images, a light-reflection layer may be provided on the back side of the thermosensitive recording layer. Owing to the light-reflection layer, the image contrast can be improved even though the thickness of the recording layer is decreased. The light-reflection layer can be prepared by deposition of Al, Ni or Sn.

The reversible thermosensitive recording material (1) can be obtained by forming a reversible thermosensitive recording layer on a support. To form the reversible thermosensitive recording layer on the support, a solution in which the matrix resin and the organic low-molecular-weight material are dissolved, or a matrix resin solution of the organic low-molecular-weight material which is dispersed in the form of finely-divided particles therein is coated on the support such as a plastic film, glass plate or metallic plate, and then dried. When the matrix resin solution of the organic low-molecular-weight material is employed, it is necessary to use a solvent which does not dissolve therein at least one of the organic-low-molecular-weight materials to be contained.

The solvent used for the formation of the thermosensitive recording layer or for the preparation of the reversible thermosensitive recording material (1) can be selected depending on the type of organic low-molecular-weight material and the kind of matrix resin to be employed. For example, tetrahydrofuran, methyl ethyl ketone, methyl isobutyl ketone, chloroform, carbon tetrachloride, ethanol, toluene and benzene can be employed. When not only the above-mentioned dispersion of the organic low-molecular-weight material, but also the solution of the matrix resin and the low-molecular-weight material is employed as the coating liquid, the organic low-molecular-weight material separates out in the form of finely-divided particles, which are dispersed in the obtained thermosensitive recording layer.

It is preferable to employ such matrix resins that can uniformly hold the particles of the organic low-molecular-weight material therein, and impart high transparency to the recording layer when the recording layer is in a maximum transparent state, and are mechanically stable and have excellent film-forming properties. Specific examples of the matrix resin include polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer and vinyl chloride-acrylate copolymer; polyvinylidene chloride; vinylidene chloride copolymers such as vinylidene chloride-vinyl chloride copolymer and vinylidene chloride-acrylonitrile copolymer; polyester; polyamide; polyacrylate, polymethacrylate and acrylate-methacrylate copolymer; and silicone resin. These resins may be used alone or in combination.

The organic low-molecular-weight material for use in the reversible thermosensitive recording material (1) may appropriately be selected form the materials which are changeable from the polycrystalline state to the single crystalline state in accordance with each of the desired temperatures ranging from $T_0$ to $T_4$ as shown in FIG. 4. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids, and esters, amides and ammonium slats thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials may be used alone or in combination.

It is preferable that the number of carbon atoms of the above-mentioned organic low-molecular-weight material be in the range of 10 to 60, more preferably in the range of 10 to 38, further preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable that the organic low-molecular-weight materials comprise, for instance —OH, —COOH, —CONH, —COOR (wherein R is $NH_4$ or an alkyl group having 1 to 20 carbon atoms), —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, and oleic acid; esters of higher fatty acids such as methyl stearate, tetradecyl stearate, octadecyl stearate, octadecyl laurate, tetradecyl palmitate and dedecyl behenate; and the following ethers or thioethers:

$C_{16}H_{33}-O-C_{16}H_{33}$, $C_{16}H_{33}-S-C_{16}H_{33}$, $C_{18}H_{37}-S-C_{18}H_{37}$, $C_{12}H_{25}-S-C_{12}H_{25}$, $C_{19}H_{39}-S-C_{19}H_{39}$, $C_{12}H_{25}-S-S-C_{12}H_{25}$,

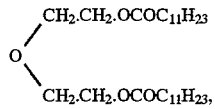

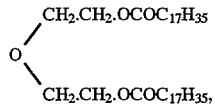

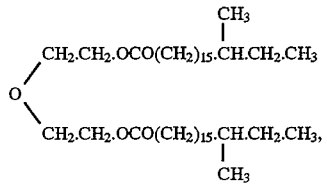

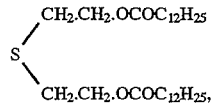

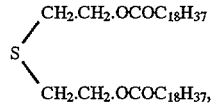

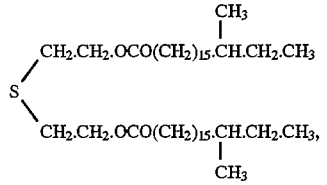

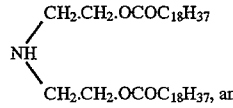

-continued

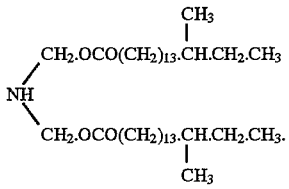

Of these, higher fatty acids having 16 or more carbon atoms, more preferably having 16 to 24 carbon atoms, such as palmitic acid, stearic acid, behenic acid and lignoceric acid are preferred in the present invention.

To increase the temperature region where the reversible thermosensitive recording material (1) is in the transparent state, the above-mentioned organic low-molecular-weight materials may appropriately be used in combination. Alternatively, the above-mentioned organic low-molecular-weight material may be used in combination with other materials having a different melting point, as disclosed in Japanese Laid-Open Patent Applications 63-39378 and 63-130380, and Japanese Patent Applications 63-14754 and 1-140109.

It is preferable that the ratio by weight of the amount of the organic low-molecular-weight material to the amount of the matrix resin be in the range of about (2:1) to (1:16), more preferably in the range of (1: 2) to (1:8). When the organic low-molecular-weight material is contained in the matrix resin within the above range, the matrix resin can form a film in which the organic low-molecular-weight material is uniformly dispersed, and the obtained recording layer can readily reach the maximum white opaque state.

In the reversible thermosensitive recording layer of the recording material (1), additives such as a surface-active agent and a high-boiling point solvent may be contained to facilitate the formation of a transparent image.

Specific examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethylbutyrate, methyl acetylricinoleate, butyl acetylricinoleate, butylphthalyl butyl glycolate and tributyl acetylcitrate.

Specific examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil of higher fatty acid, and polypropylene glycol; acetylene glycol; sodium, calcium, barium and magnesium salts of higher alkyl benenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene-maleic anhydride copolymer; and olefin-maleic anhydride copolymer.

Furthermore, the thermosensitive recording layer may be prepared by cross-linking by the application of thermal energy, ultraviolet light, or electron beam (EB) to improve the repetition durability of the recording layer. In particular, the recording layer prepared by cross-linking by use of the electron beam is preferable.

In the reversible thermosensitive recording material (1) for use in the present invention, a protective layer may be formed in the reversible thermosensitive recording layer for protecting the thermosensitive recording layer. The preferable thickness of the protective layer is in the range of 0.1 to 5 μm. Examples of the material for the protective layer include silicone rubber or silicone resin (described in Japanese Laid-Open Patent Application 63-221087), polysiloxane graft polymer (described in Japanese Patent Application 62-152550), and ultraviolet-curing resin or electron-radiation-curing resin (described in Japanese Patent Application 63-310600). In any case, any solvent that cannot easily dissolve the matrix resin and the organic low-molecular-weight material for use in the thermosensitive recording layer is employed for the preparation of a coating liquid for the protective layer.

Preferable examples of the solvent for use in the coating liquid for the protective layer include n-hexane, methyl alcohol, ethyl alcohol and isopropyl alcohol. In particular, alcohol-based solvents are preferred from the viewpoint of cost.

Further, an intermediate layer may be interposed between the protective layer and the thermosensitive recording layer to protect the thermosensitive recording layer from the solvent or a monomer component for use in the coating liquid for the protective layer.

As a material for use in the coating liquid for the intermediate layer, the same resins as used for the matrix resin the thermosensitive recording layer, and other thermosensitive resins and thermoplastic resins such as polyethylene, polypropylene, polystyrene, polyvinyl alcohol, polyvinyl butyral, polyurethane, saturated polyester, unsaturated polyester, epoxy resin, phenolic resin, polycarbonate, and polyamide can be used.

The thickness of the intermediate layer is preferably in the range from about 0.1 to 2 μm.

The previously mentioned reversible thermosensitive recording material (2) which is used for the image recording portions in the recording medium will now be explained in detail.

The recording material (2) comprises a reversible thermosensitive coloring composition comprising an electron donor type coloring compound and an electron acceptor type compound, and the electron acceptor compound is capable of inducing color formation in the electron donor coloring compound upon application of heat thereto.

More specifically, when a mixture of the electron donor coloring compound and the electron acceptor compound is fused under application of heat thereto, an amorphous coloring material is generated therein. Thus, a color development state is formed. The temperature at which the color development state is formed is hereinafter referred to as a color development temperature. Subsequently, when the amorphous coloring material thus obtained in the mixture is heated at a temperature lower than the color development temperature, the color in the coloring material disappears with the crystallization of the electron acceptor compound. Thus, a decolorization state is formed.

This kind of reversible thermosensitive coloring composition shows a surprising behavior of reversible color development and decolorization. The coloring composition instantaneously induces color development by the application of heat thereto, and the thus obtained color development state can be maintained in a stable condition at room temperature. The color produced in the coloring composition in the color development state abruptly disappears when the coloring composition is heated at a temperature lower than the color development temperature, and the thus obtained decolorization state can be maintained at room temperature.

The process of color development and decolorization, namely, the process of image formation and erasure, by use of the reversible thermosensitive recording material (2) comprising the above-mentioned thermosensitive coloring composition will be explained with reference to the graph shown in FIG. 5.

Figure 5:
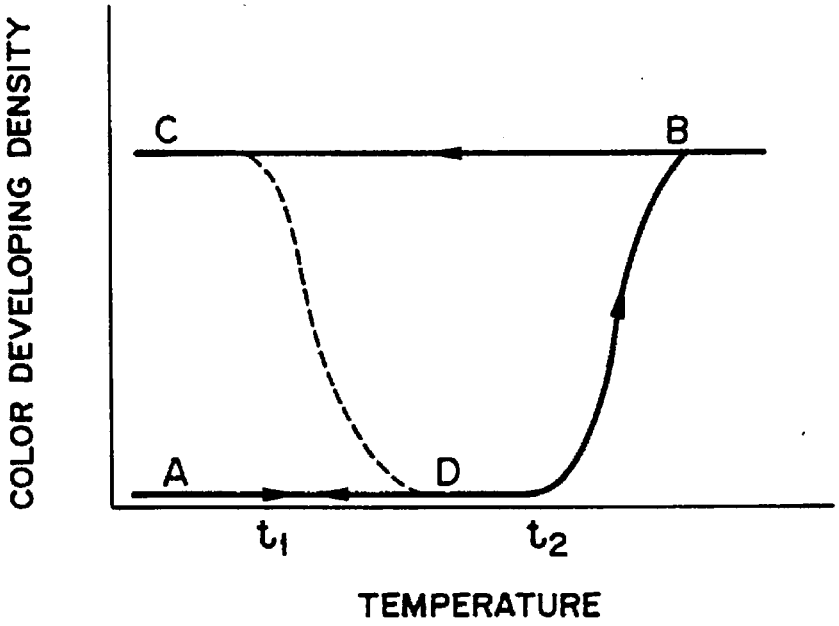
FIG. 5 is a graph which shows the relationship between the color developing density of a recording material for use in the present invention and the temperature thereof.

In FIG. 5, the color developing density of the recording material (2) is plotted as ordinate and the temperature thereof as abscissa. The image formation process by heating operation is represented by a solid line, and the image erasure process by heating operation, by a dashed line. Density A indicates an original density of the recording material (2) in the complete decolorization state; density B, a density in the complete color development state obtained by heating the coloring composition at temperature of $t_2$ or more; density C, a density in the complete color development state at temperature $t_1$ or less; and density D, a density in the complete decolorization state obtained when the coloring composition in the color development state at $t_1$ or less is heated at a temperature in the range from $t_1$ to $t_2$.

The coloring composition is originally in a decolorization state with the density A at temperature $t_1$ or less. When the coloring composition is heated to temperature $t_2$ or more, for example by use of a thermal head, in order to carry out the image formation, the coloring composition induces color development and the color developing density reaches the density B. The thus obtained density B of the coloring composition does not decrease even though the coloring composition is cooled to $t_1$ or less as indicated by the solid line, and the density of the obtained image can be maintained as the density C. Thus, the recording characteristics of images are regarded as satisfactory.

To erase the image formed in the recording material (2), the coloring composition for use in the recording material (2) which is in the color development state at $t_1$ or less may be again heated to a temperature in the range from $t_1$ to $t_2$, which is lower than the color development temperature, as indicated by the dashed line. Thus, the image density is decreased from C to D, thereby allowing the coloring composition to assume a decolorization state. Once the coloring composition assumes a decolorization state, the density D of the coloring composition is maintained to the density A even though the temperature of the coloring composition is returned to $t_1$ or less. In other words, the image forming operation proceeds in accordance with the solid line A-B-C, and the recorded image is maintained in the recording material (2) at the step C. The image erasing operation proceeds in accordance with the dashed line C-D-A, and the decolorization state of the recording material (2) can be maintained at the step A. Such a behavior of image formation and erasure has a reversible characteristic, and these operations can be repeated over a long period of time.

As previously mentioned, the reversible thermosensitive coloring composition for use in the recording material (2) comprises the electron donor coloring compound serving as a coloring agent and the electron acceptor compound serving as a color developer. When a mixture of the coloring agent and the color developer is fused by the application of heat thereto, it assumes a color development state; and when the mixture in the color development state is again heated at a temperature lower than the color development temperature, the color produced in the mixture of the coloring agent and the color developer disappears. Both the color development state and the decolorization state can be maintained in a stable condition at room temperature. The color development of the coloring composition takes place when the coloring composition becomes amorphous by heating it at the color development temperature. On the other hand, when the coloring composition in the color development state is again heated to a temperature lower than the color development temperature, the decolorization is induced by the crystallization of the color developer in the coloring composition.

For the subsequent image formation in the recording material (2), it is advantageous to heat the recording material (2) at a temperature within the range from $t_1$ to $t_2$ to erase the image, thereby returning the particles of the coloring agent and the color developer to the original condition.

As compared with the reversible thermosensitive coloring composition for use in the recording material (2), a coloring composition widely used in a conventional thermosensitive recording sheet, for example, comprising a leuco compound having a lactone ring which is a dye precursor, and a phenolic compound serving as a color developer is different in the color development and decolorization behavior. This kind of coloring composition assumes a color development state because the lactone ring of the leuco compound is opened when a mixture of the leuco compound and the phenolic compound is fused under application of heat thereto. In such a color development state, the coloring composition assumes an amorphous state in which both the leuco compound and the phenolic compound are soluble in each other. The amorphous state of the coloring composition can be maintained in a stable condition when the temperature of the coloring composition is lowered to room temperature. Thereafter, even through the coloring composition in the amorphous state is again heated, the phenolic compound does not crystallize out of the leuco compound, so that the lactone ring of the leuco compound is not closed, with the result that the color produced in the coloring composition does not disappear.

In contrast to the above, with respect to the reversible thermosensitive coloring composition for use in the recording material (2), when it is heated to a temperature lower than the color development temperature, in other words, the coloring composition is heated so as not to allow the coloring composition to fuse, after it assumes an amorphous state in the color development state, crystallization of the color developer takes place, so that it becomes difficult to hold the compatible condition between the color developer and the coloring agent. Thus, the color developer crystallizes out of the coloring agent, and the color developer cannot accept an electron from the coloring agent, and consequently, the coloring agent is decolorized.

Such a peculiar behavior of color development and decolorization of the reversible thermosensitive coloring composition for use in the recording material (2) is affected by the mutual solubility of the coloring agent and the color developer when they are fused under application of heat thereto, the intensity of the actions of the coloring agent and the color developer in the color development state, the solubility of the color developer in the coloring agent, and the crystallizability of the color developer. In principle, any coloring composition comprising a coloring agent and a color developer that can assume an amorphous state when fused under application on heat thereto, and that can crystallize when heated at a temperature lower than the color development temperature can be employed for the recording material (2) in the present invention. Such a coloring composition indicates endothermic change in the course of fusion, and exothermic change in the course of crystallization according to the thermal analysis. Therefore, it is easy to find the coloring composition suitable for the recording material (2) by the thermal analysis. In addition, the reversible thermosensitive coloring composition for use in the recording material (2) may comprise a third material, for example, a polymeric material. It has been confirmed that the coloring composition further comprising the polymeric material can show the same behavior of color development and decolorization as previously stated.

The decolorization of the reversible thermosensitive coloring composition results from the crystallization of the color developer out of the coloring agent. With this fact taken into consideration, the selection of the color developer is significant for obtaining the recording material (2) which can show excellent decolorization performance.

Preferable examples of the color developer for use in the recording material (2) are shown below, which can easily be found by the thermal analysis, so that they are not limited to the following compounds.

(1) Organic phosphoric acid compounds represented by formula (1):

$$R^1—PO(OH)_2 \quad (1)$$

wherein $R^1$ represents a straight-chain or branched alkyl group or alkenyl group having 8 to 30 carbon atoms.

Specific examples of the aforementioned organic phosphoric acid compound are octyl phosphonic acid, nonyl phosphonic acid, decyl phosphonic acid, dodecyl phosphonic acid, tetradecyl phosphonic acid, hexadecyl phosphonic acid, octadecyl phosphonic acid, eicosyl phosphonic acid, docosyl phosphonic acid and tetracosyl phosphonic acid.

(2) Organic acids having a hydroxyl group at the α-position, represented by formula (2):

$$R^2—CH(OH)COOH \quad (2)$$

wherein $R^2$ represents a straight-chain or branched alkyl group or alkenyl group having 6 to 28 carbon atoms.

Specific examples of the aforementioned organic acid having a hydroxyl group at the α-position include α-hydroxyoctanoic acid, α-hydroxydodecanoic acid, α-hydroxytetradecahoic acid, α-hydroxyhexadecanoic acid, α-hydroxyoctadecanoic acid, α-hydroxypentadecanoic acid, α-hydroxyeicosanoic acid, and α-hydroxydecosanoic acid.

The coloring agent for use in the recording material (2) is an electron donor compound, such as a colorless or light-colored dye precursor. For example, conventionally known leuco compounds such as triphenylmethane phthalide compounds, fluoran compounds, phenothiazine compounds, leuco auramine compounds, rhodamine lactam compounds, spiropyran compounds and indolinophthalide compounds can be employed.

Specific examples of those leuco dyes are as follows:

3,3-bis(p-dimethylaminophenyl)-phthalide, 3,3-bis(p-dimethylaminophenyl)-6-dimethylaminophthalide (or Crystal Violet Lactone), 3,3-bis(p-dimethylaminophenyl)-6-dimethylaminophthalide 3,3-bis(p-dimethylaminophenyl)-6-chlorophthalide, 3,3-bis(p-dibutylaminophenyl)-phthalide, 3-cyclohexylamino-6-chlorofluoran, 3-dimethylamino-5,7-dimethylfluoran, 3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-6-(o-chloroanilino)xanthylbenzoic acid lactam],
3-diethylamino-6-methyl-7-(m-trichloromethyl-anilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran,
Benzoyl leuco methylene blue,
6'-chloro-8'-methoxy-benzoindolino-spiropyran,
6'-bromo-2'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methoxyphenyl)phthalide,
3-morpholino-7-(N-propyl-trifluoromethylanilino)-fluoran
3-diethylamino-5-chloro-7-(N-benzyl-trifluoromethylanilino)fluoran,
3-pyrrolidino-7-(di-p-chlorophenyl)methylamino-fluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)fluoran,
3-diethylamino-5-methyl-7-(α-phenylethylamino)fluoran,
3-diethylamino-7-piperidinofluoran,
2-chloro-3-(N-methoxyltoluidino)-7-(p-n-butylanilino)fluoran,
3-(N-methyl-N-isopropylamino)-6-methyl-7-anilinofluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-N-ethyl-N-(2-ethoxypropyl)amino-6-methyl-7-anilinofluoran,
3-N-ethyl-N-tetrahydrofurfurylamino-6-methyl-7-anilinofluoran,
3-diethylamino-6-methyl-7-mesidino-4',5'-benzofluoran,
3-N-methyl-N-isobutyl-6-methyl-7-anilinofluoran,
3-N-ethyl-N-isoamyl-6-methyl-7-anilinofluoran, and
3-diethylamino-6-methyl-7-(2',4'-dimethylanilino)fluoran.

It is preferable that the coloring agent for use in the recording material (2) have a substituent containing a halogen atom. Specific examples of such a preferable coloring agent are as follows:

3,3-bis(p-dimethylaminophenyl)-6-chlorophthalide,
3-cyclohexylamino-6-chlorofluoran,
3-cyclohexylamino-6-bromofluoran,
3-diethylamino-7-chlorofluoran,
3-diethylamino-7-bromofluoran,
3-dipropylamino-7-chlorofluoran,
3-diethylamino-6-chloro-7-phenylamino-fluoran,
3-phrrolidoino-6-chloro-7-phenylamino-fluoran,
3-diethylamino-6-chloro-7-(m-trifluoromethylphenyl)amino-fluoran,
3-cyclohexylamino-6-chloro-7-(o-chlorophenyl)amino-fluoran,
3-diethylamino-6-chloro-7-(2'-3'-dichlorophenyl)amino-fluoran,
3-diethylamino-6-methyl-7-chlorofluoran,
3-dibutylamino-6-chloro-7-ethoxyethylamino-fluoran,
3-diethylamino-7-(o-bromophenyl)amino-fluoran,
3-diethylamino-7-(o-chlorophenyl)amino-fluoran,
3-dibutylamino-7-(o-fluorophenyl)amino-fluoran,
6'-bromo-3'-methoxybenzoindolino-spiropyran,
3-(2'-methoxy-4'-dimethylaminophenyl)-3-(2'-hydroxy-4'-chloro-5'-chlorophenyl)phthalide,
3-(2'-hydroxy-4'-dimethylaminophenyl)-3-(2'-methoxy-5'-chlorophenyl)phthalide, and
2-[3,6-bis(diethylamino)]-9-(o-chlorophenyl)-amino-xanthylbenzoic acid lactam.

Further preferable examples of the coloring agent for use in the recording material (2) are compounds represented by the following formula (3):

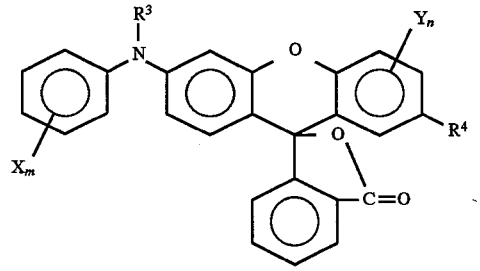

(3)

wherein $R^3$ represents hydrogen or an alkyl group having 1 to 4 carbon atoms; $R^4$ represents hydrogen or an amino group which may have a substituent; X represents hydrogen, an alkyl group having 1 to 4 carbon atoms, or phenylamino group; m is an integer of 1 or 2; Y represents an alkyl group having 1 to 4 carbon atoms or an alkoxyl group having 1 or 2 carbon atoms; and n is an integer of 1 or 2.

Specific examples of the compound represented by the above-mentioned formula (3) are as follows:

3-(N-methyl-N-phenylamino)-7-amino-fluoran,
3-(N-ethyl-N-phenylamino)-7-amino-fluoran,
3-(N-propyl-N-phenylamino)-7-amino-fluoran,
3-[N-methyl-N-(p-methylphenyl)amino]-7-amino-fluoran,
3-[N-ethyl-N-(p-methylphenyl)amino]-7-amino-fluoran,
3-[N-propyl-N-(p-methylphenyl)amino]-7-amino-fluoran,
3-[N-methyl-N-(p-ethylphenyl)amino]-7-amino-fluoran,
3-[N-ethyl-N-(p-ethylphenyl)amino]-7-amino-fluoran,
3-[N-propyl-N-(p-ethylphenyl)amino]-7-amino-fluoran,
3-[N-methyl-N-(2',4'-dimethylphenyl)amino]-7-amino-fluoran,
3-[N-ethyl-N-(2',4'-dimethylphenyl)amino]-7-amino-fluoran,
3-[N-propyl-N-(2',4'-dimethylphenyl)amino]-7-amino-fluoran,
3-[N-methyl-N-(p-chlorophenyl)amino]-7-amino-fluoran, 3-[N-ethyl-N-(p-chlorophenyl)amino]-7-amino-fluoran,
3-[N-propyl-N-(p-chlorophenyl)amino]-7-amino-fluoran,
3-(N-methyl-N-phenylamino)-7-methylamino-fluoran,
3-(N-ethyl-N-phenylamino)-7-methylamino-fluoran,
3-(N-propyl-N-phenylamino)-7-methylamino-fluoran,
3-[N-methyl-N-(p-methylphenyl)amino]-7-ethylamino-fluoran,
3-[N-ethyl-N-(p-methylphenyl)amino]-7-benzylamino-fluoran,
3-[N-methyl-N-(2',4'-dimethylphenyl)amino]-7-methylamino-fluoran,
3-[N-ethyl-N-(2',4'-dimethylphenyl)amino]-7-ethylamino-fluoran,
3-[N-methyl-N-(2',4'-dimethylphenyl)amino]-7-benzylamino-fluoran,
3-[N-ethyl-N-(2',4'-dimethylphenyl)amino]-7-benzylamino-fluoran,
3-(N-methyl-N-phenylamino)-7-dimethylamino-fluoran,
3-(N-ethyl-N-phenylamino)-7-dimethylamino-fluoran,
3-[N-methyl-N-(p-methylphenyl)amino]-7-diethylamino-fluoran,
3-[N-ethyl-N-(p-methylphenyl)amino]-7-diethylamino-fluoran,
3-(N-methyl-N-phenylamino)-7-dipropylaminofluoran,
3-(N-ethyl-N-phenylamino)-7-dipropylaminofluoran,
3-[N-methyl-N-(p-methylphenyl)amino]-7-dibenzylamino-fluoran,
3-[N-ethyl-N-(p-methylphenyl)amino]-7-dibenzylamino-fluoran,
3-[N-ethyl-N-(p-methylphenyl)amino]-7-di(p-methybenzyl)amino-fluoran,
3-[N-methyl-N-(p-methylphenyl)amino]-7-acetylamino-fluoran,
3-[N-ethyl-N-(p-methylphenyl)amino]-7-benzoylamino-fluoran,
3-[N-methyl-N-(p-methylphenyl)amino]-7-(o-methoxybenzoyl)amino-fluoran,
3-[N-ethyl-N-(p-methylphenyl)amino]-6-methyl-7-phenylamino-fluoran,
3-[N-methyl-N-(p-methylphenyl)amino]-6-methyl-7-phenylamino-fluoran,
3-[N-methyl-N-(p-methylphenyl)amino]-6-tert-butyl-7-(p-methylphenyl)amino-fluoran,
3-(N-ethyl-N-phenylamino-6-methyl-7-(N-ethyl-N-(p-methylphenyl)amino-fluoran,
3-[N-propyl-N-(p-methylphenyl)amino]-6-methyl-7-[N-methyl-N-(p-methylphenyl)amino-fluoran,
3-[N-ethyl-N-(p-methylphenyl)amino]-5-methyl-7-benzylamino-fluoran,
3-[N-ethyl-N-(p-methylphenyl)amino]-5-chloro-7-dibenzylamino-fluoran,
3-[N-methyl-N-(p-methylphenyl)amino]-5-methoxy-7-dibenzylamino-fluoran,
3-[N-ethyl-N-(p-methylphenyl)amino]-6-methyl-fluoran, and
3-[N-ethyl-N-(p-methylphenyl)amino]-5-methoxy-fluoran, The previously mentioned color developers can be used alone or in combination. The coloring agents can also be used alone or in combination.

By forming a thermosensitive recording layer comprising the reversible thermosensitive coloring composition on a support, the reversible thermosensitive recording material (2) for use in the present invention can be prepared. In this case, the coloring agent, the color developer and a binder agent are uniformly dispersed or dissolved in water or an appropriate organic solvent by a conventional method to prepare a coating liquid for the thermosensitive recording layer. Thereafter, the coating liquid for the recording layer thus prepared is coated on the support.

Examples of the binder agent for use in the coating liquid for the thermosensitive recording layer are various kinds of conventional binder agents, such as polyvinyl alcohol, hydroxyethyl cellulose, hydroxypropyl cellulose, methoxy cellulose, carboxymethyl cellulose, methyl cellulose, cellulose acetate, gelatin, casein, starch, sodium polyacrylate, polyvinyl pyrrolidone, polyacrylamide, maleic acid compolymer, acrylic acid copolymer, polystyrene, polyvinyl chloride, polyvinyl acetate, polyacrylate, polymethacrylate, vinyl chloride-vinyl acetate copolymer, styrene copolymer, polyester, and polyurethane.

When necessary, a variety of auxiliary additive components which are used in the conventional thermosensitive recording materials, such as a dispersant, a surface active agent, a filler, a colored image stabilizing agent, an antioxidant, a light stabilizer and a lubricant can be employed with the above-mentioned leuco dye and the color developer for the improvements in coating properties of the coating liquid and the recording characteristics of the obtained recording material (2).

The protective layer and the intermediate layer may also be provided in this kind of reversible thermosensitive recording material (2).

As the support for the reversible thermosensitive recording material (2), a sheet of paper or synthetic paper, a plastic film, and the composite material thereof may be employed in accordance on the application of the recording material (2).

The recording medium for use with the image formation method of the present invention may be in the form of a card or in continuous lengths. Alternatively, the recording medium in the form of an endless-belt can be employed.

Other features of this invention will become apparent in the course of the following description of exemplary embodiments which are given for illustration of the invention and are not intended to be limiting thereof.

EXAMPLE 1

[Preparation of Recording Medium]

(Formation of Magnetic Recording Layer)

The following components were mixed to prepare a coating liquid for a magnetic recording layer:

| | Parts by Weight |
|---|---|
| $\gamma$-$Fe_2O_3$ | 10 |
| Vinyl chloride/vinyl acetate/vinyl alcohol copolymer (Trademark "VAGH", made by Union Carbide Japan K.K. | 2 |
| 10% toluene solution of "Coronate L" (Trademark), made by Nippon Polyurethane Industry Co., Ltd. | 2 |
| Methyl ethyl ketone | 43 |
| Toluene | 43 |

The thus obtained coating liquid was coated on a white polyethylene terephthalate (PET) film with a thickness of about 188 μm serving as a support by a wire bar, and dried under application of heat thereto, so that a magnetic recording layer with a thickness of about 10 μm was formed on the support.

(Formation of Smoothing Layer)

The following components were mixed to prepare a coating liquid for a smoothing layer:

| | Parts by Weight |
|---|---|
| 75% butyl acetate solution of urethane acrylate-based ultraviolet-curing resin (Trademark: "Unidic C7-164" made by Dainippon Ink & Chemicals, Incorporated.) | 10 |
| Methyl ethyl ketone | 10 |

The thus obtained coating liquid was coating on the above prepared magnetic recording layer by a wire bar, dried under application of heat thereto, and cured by the irradiation of an ultraviolet lamp of 80 W/cm, so that a smoothing layer with a thickness of about 3 μm was formed on the magnetic recording layer.

(Formation of Light-reflection Layer)

Al was deposited on the above prepared adhesive layer, so that a light-reflection layer with a thickness of about 400 Å was formed on the smoothing layer.

(Formation of Reversible Thermosensitive Recording Layer)

The following components were mixed to prepare a coating liquid for a reversible thermosensitive recording layer:

| | Parts by Weight |
|---|---|
| Behenic acid (Trademark: "NAA-22S", made by Nippon Oils and Fats Co., Ltd.) | 6 |
| Eicosanedioic acid (Trademark: "SL-20", made by Okamura Oil Mill Ltd.) | 4 |
| Vinyl chloride-vinyl acetate-phosphate copolymer (Trademark: "Denka Vinyl #1000p", made by Denki Kagaku Kogyo K.K.) | 35 |
| Diisodecyl phthalate | 3 |
| Tetrahydrofuran | 150 |
| Toluene | 15 |

The thus obtained coating liquid for a recording layer was coated on the above prepared light-reflection layer by a wire bar, and then dried under application of heat thereto, so that a reversible thermosensitive recording layer with a thickness of about 15 μm was formed on the light-reflection layer.

(Formation of Intermediate Layer)

The following components were mixed to prepare a coating liquid for an intermediate layer:

| | Parts by Weight |
|---|---|
| Polyamide resin (Trademark: "CM8000", made by Toray Silicone Co., Ltd.) | 10 |
| Methanol | 90 |

The thus prepared coating liquid was coated on the above prepared reversible thermosensitive recording layer by a wire bar, and dried under application of heat thereto, so that an intermediate layer with a thickness of about 1 μm was formed on the recording layer.

(Formation of Protective Layer)

The following components were mixed to prepare a coating liquid for a protective layer:

| | Parts by Weight |
|---|---|
| 75% butyl acetate solution of urethane acrylate-based ultraviolet-curing resin (Trademark: "Unidic C7-157", made by Dainippon Ink & Chemicals, Incorporated.) | 10 |
| Isopropyl alcohol | 10 |

The thus obtained coating liquid was coated on the above prepared intermediate layer by a wire bar, dried under application of heat thereto, and cured by the irradiation of an ultraviolet lamp of 80 W/cm, so that a protective layer with a thickness of about 5 μm was formed on the intermediate layer.

Thus, a recording medium 1 for use in the present invention was obtained. In the recording medium 1, there were provided two different portions 11 and 12 comprising the above prepared reversible thermosensitive recording material, and a non-image recording portion 13, as shown in FIG. 1.

The thus obtained recording medium 1 was heated at 80° C. to make the reversible thermosensitive recording layer of the recording medium 1 transparent.

As shown in FIG. 1, a pattern was printed on the non-image recording portion 13 of the recording medium 1 by offset printing using a commercially available set of UV curing ink (yellow, magenta, cyan and black) "UVS PCD W" (Trademark), made by Morohoshi Printing Ink Co., Ltd. and then cured by the irradiation of ultraviolet light.

Using a thermal head, symbols for numbers were formed in a milky white color in the portion 11 and the images thus formed were erased by the application of heat thereto using the thermal head. Similarly, the image forming and erasing operation was carried out in the portion 12 using the thermal head. Such an image forming and erasing operation was repeated 200 times in the portions 11 and 12 at random. As a result, there was observed a slight deterioration in the recorded images due to the decrease of whiteness degree of milky opaque images.

In contrast to this, when the image forming and erasing operation was carried out only in the portion 11, the deterioration of recorded images was observed after the image forming and erasing operation was repeated about 100 times.

Furthermore, the maximum number of times for the use of the recording medium 1 was preset to 90 as the magnetic information in the magnetic recording layer provided under the recording layer. The image forming and erasing operation was carried out 90 times in the portion 11 of the recording medium 1, and then the image forming and erasing operation was further carried out 90 times in the portion 12. As a result, no deterioration was observed in the recorded images.

Figure 6:
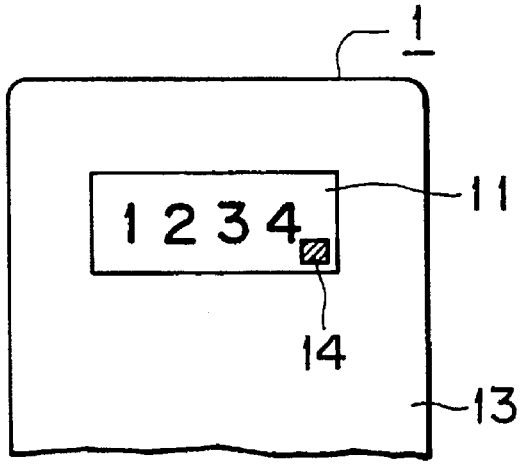
FIG. 6 is a schematic plan view of one embodiment of a recording medium for use with the image formation method of the present invention, which is provided with a portion capable of detecting the degree of deterioration of the reversible thermosensitive recording material.

In addition, a deterioration-detecting portion 14 was provided in the lower right hand corner of the portion 11 in the recording medium 1, as shown in FIG. 6. Every time the image forming operation is carried out in the portion 11, a white opaque image was formed in the deterioration-detecting portion 14, and the reflectance of the white opaque image formed in the portion 14 was measured, thereby detecting the degree of deterioration of the recording material. When the image forming and erasing operation was repeated 95 times in the image recording area 11, there was no deterioration of the recorded images by visual observation although the deterioration of the recording material was detected in the deterioration-detecting portion 14. Therefore, the portion to be used for image formation was shifted from the portion 11 to the portion 12. When the image forming and erasing operation was further carried out 95 times in the portion 12, there was no deterioration by visual observation. It was possible to carry out the image forming and erasing operations 190 times in total in the recording medium 1 using the portions 11 and 12.

Further, the image forming and erasing operation was carried out only in the portion 1 of the recording medium 1 in such a manner that different portions of the recording layer were selectively set by shifting a predetermined portion of the recording layer so that a current symbol of a number might not overlap the previous one in the course of the successive formation and/or erasure of images, as shown in FIG. 2(*c*). As a result, there was no deterioration in the recorded images until the image forming and erasing operation was repeated 370 times. When the image forming operation was repeated 380 times, the deterioration was observed in the recorded images.

According to the image formation method of the present invention, as previously explained, the life of the recording medium comprising the reversible thermosensitive recording material can drastically be increased because images are formed and/or erased in different portions of a recording layer of the recording medium in such a manner that the same portion is not continuously used for image formation and/or erasure in excess of a predetermined number of times.

What is claimed is:

1. A method of successively forming and/or erasing an image selectively in different portions of a single recording area of a recording medium which comprises a successive thermosensitive recording material comprising the step of successively forming an image and/or erasing a previously formed image on said recording layer by the application of heat thereto, depending upon the temperature thereof, in such a manner that a same portion of said single recording area is not continuously used for image formation and/or erasure excessively, wherein said different portions of said recording layer are selectively set by shifting said recording layer within said single recording area in the course of said successively forming an image and/or erasing a previously formed image.

2. The method as claimed in claim 1, wherein said same portion of said single recording area is subjected to image formation, image erasure or both more than 1 time.

* * * * *

UNITED STATES PATENT AND TRADEMARK OFFICE

CERTIFICATE OF CORRECTION

PATENT NO. : 5,635,319
DATED : JUNE 3, 1997
INVENTOR(S) : YOSHIHIKO HOTTA ET AL

It is certified that error appears in the above-identified patent and that said Letters Patent is hereby corrected as shown below:

Column 4, line 51, "umbers" should read --numbers--.

Column 6, line 58, "through" (2nd Occur.) should read --though--.

Column 8, line 60, "lo-" should read --low- --.

Column 10, line 61, "slats" should read --salts--.

Column 12, line 56, "benenesulfonic" should read --benzenesulfonic--.

Column 16, line 47, "α-hydroxytetradecahoic" should read --α-hydroxytetradecanoic--.

Column 18, line 8, "phrrolidoino" should read --pyrrolidino--.

Column 20, line 11, "compolymer" should read --copolymer--.

Column 24, line 6, "successive" should read --reversible--.

Signed and Sealed this

Ninth Day of June, 1998

*Attest:*

Bruce Lehman

BRUCE LEHMAN

*Attesting Officer*

*Commissioner of Patents and Trademarks*